US012729932B2

(12) United States Patent
Zhang

(10) Patent No.: US 12,729,932 B2
(45) Date of Patent: Sep. 8, 2026

(54) SEMI-OPEN PISTOL STORAGE DEVICE

(71) Applicant: Shenzhen Hanmai Technology Co., Ltd, Shenzhen (CN)

(72) Inventor: Wenyuan Zhang, Zhangshu (CN)

(73) Assignee: Shenzhen Hanmai Technology Co., Ltd, Shenzhen (CN)

( * ) Notice: Subject to any disclaimer, the term of this patent is extended or adjusted under 35 U.S.C. 154(b) by 0 days.

(21) Appl. No.: 19/074,599

(22) Filed: Mar. 10, 2025

(65) Prior Publication Data

US 2025/0207890 A1 Jun. 26, 2025

(30) Foreign Application Priority Data

Mar. 20, 2024 (CN) ..... 202420545467.3

(51) Int. Cl.
*F41C 33/06* (2006.01)
*F41A 17/54* (2006.01)
*F42B 39/26* (2006.01)

(52) U.S. Cl.
CPC ..... *F41C 33/06* (2013.01); *F41A 17/54* (2013.01); *F42B 39/26* (2013.01)

(58) Field of Classification Search
CPC ..... F41A 17/54; F41A 23/18; F41A 17/06; F41C 33/06; F41C 33/0263; F42B 39/26; A47B 81/005
USPC ..... 206/315.11, 317; 42/70.06
See application file for complete search history.

(56) References Cited

U.S. PATENT DOCUMENTS

| | | | | |
|---|---|---|---|---|
| 3,419,728 | A * | 12/1968 | Wilson | F41C 33/0263 361/171 |
| 6,253,480 | B1 * | 7/2001 | Florez | F41A 17/06 42/70.07 |
| 8,006,424 | B1 * | 8/2011 | Ligard | F41A 17/02 42/70.11 |
| 10,330,436 | B2 * | 6/2019 | Romeo | F41C 33/0272 |
| 12,442,606 | B2 * | 10/2025 | Zhang | A47B 81/005 |
| 2012/0132553 | A1 | 5/2012 | Verheyen | |
| 2015/0198402 | A1 * | 7/2015 | Brace | F41A 17/54 42/70.06 |
| 2016/0054080 | A1 * | 2/2016 | Haimi | F41A 17/54 70/263 |
| 2018/0356172 | A1 * | 12/2018 | Mack | F41A 17/066 |
| 2020/0132404 | A1 * | 4/2020 | Adam Kemp | F41A 17/54 |
| 2021/0116194 | A1 | 4/2021 | Tai et al. | |
| 2024/0060739 | A1 | 2/2024 | Zhang et al. | |

* cited by examiner

*Primary Examiner* — Chun Hoi Cheung
(74) *Attorney, Agent, or Firm* — Hemisphere Law, PLLC

(57) ABSTRACT

Provided is a semi-open pistol storage device, including a body with an accommodating cavity for storing the pistol. The body is provided with a lock catch structure and an unlocking mechanism. The lock catch structure is provided with a lock catch bracket, and a lock beam assembly. The lock catch bracket is fixedly connected to the body, the lock beam assembly is rotatably connected to the lock catch bracket, and one end of the lock beam assembly, with a rotation radius thereof as a motion trajectory, pass through a trigger guard of the pistol to lock the pistol. The unlocking mechanism is provided with an unlocking bump, which can be used for unlocking the lock catch structure to make the lock beam assembly retract from the trigger guard, thereby releasing the trigger guard and enabling the pistol to be drawn from the storage device.

9 Claims, 7 Drawing Sheets

SEMI-OPEN PISTOL STORAGE DEVICE

TECHNICAL FIELD

The present disclosure relates to the technical field of pistol storage locks, and in particular to a semi-open pistol storage device.

BACKGROUND

Pistol is a short-barreled firearm designed to be held and operated with one hand for aimed shooting or instinctive shooting, which is typically carried by the user for self-defense or attacking enemies within a short range of 50 meters. Security personnel are typically required to carry a pistol during outdoor duty, but required to remove and store the pistol in an indoor office environment.

In addition, how to conveniently store the pistol in various locations, such as indoors, inside a vehicle, or under a desk in the office, also needs to be considered.

In Chinese patent document No. CN212154437U, a gun lock is provided, which includes a lock housing, where the lock housing is provided with a notch, and two opposite walls of the notch are provided with lock holes; and a locking mechanism, which is in fit with the lock housing, and composed of a driving assembly, a first elastic element, a locking assembly, and a lock lever, where the lock lever is slidably disposed in the lock hole and forms a locking space with a bottom wall of the notch, the first elastic element is positioned inside the lock hole; the lock lever slides into the lock hole to compress the first elastic element and to be locked with the locking assembly; and the driving assembly is configured to drive the locking assembly to separate from the lock lever, making the first elastic element rebound to drive the lock lever to slide out of the lock hole.

Although the trigger of the gun can be locked to prevent the trigger from being activated in the above technical solution, it is inconvenient to take off the gun quickly in an emergency due to complex structure and multiple unlocking steps.

Therefore, the technical problem to be solved is to provide a semi-open pistol storage device, the pistol can be conveniently stored, rapidly positioned and locked in the device, or rapidly drawn from the device. The user can quickly put and take the pistol during use.

SUMMARY

To overcome the shortcomings above, the present disclosure aims to provide a technical solution capable of solving the problem above.

The present disclosure provides a semi-open pistol storage device, including a body with an accommodating cavity for storing a pistol. The body is provided with a lock catch structure, and an unlocking mechanism. The lock catch structure is provided with a lock catch bracket, and a lock beam assembly. The lock catch bracket is fixedly connected to the body, the lock beam assembly is rotatably connected to the lock catch bracket, and one end of the lock beam assembly passes through a trigger guard of the pistol with a rotation radius thereof as a motion trajectory to lock the pistol. The unlocking mechanism is provided with an unlocking bump, which can unlock the lock catch structure to make the lock beam assembly retract from the trigger guard, thus releasing the trigger guard and enabling the pistol to be drawn from the storage mechanism.

As a further solution of the present disclosure, the lock beam assembly is provided with an annular lock beam, the annular lock beam is rotatably connected to the lock catch bracket along a center shaft thereof, one end of the annular lock beam is provided with a lock hook, and the other end of the annular lock beam is provided with a handle post. By pushing the handle post, the annular lock beam can be rotated by a certain angle, thus enabling the lock hook to pass through the trigger guard of the pistol with a rotation radius as a motion trajectory to lock the pistol.

As a further solution of the present disclosure, the lock beam assembly is provided with a hooked lock beam, one end of the hooked lock beam is provided with a hook claw, and the other end of the hooked lock beam is provided with a lock beam gear. A center shaft of the lock beam gear is rotatably connected to the lock catch bracket; and an inner side of the lock beam assembly is provided with internal gear teeth. The internal gear teeth are meshed with gear teeth of the lock beam gear, enabling the lock beam assembly to drive the hooked lock beam to synchronously rotate by a certain angle, and further enabling the hook claw to pass through the trigger guard of the pistol with a rotation radius thereof as a motion trajectory to lock the pistol.

As a further solution of the present disclosure, the lock beam assembly is further provided with a third gear and a fourth gear rotatably connected to the lock catch bracket, respectively. The third gear is meshed with the internal gear teeth and the fourth gear, respectively. The fourth gear is meshed with the third gear and the lock beam gear, respectively, thus transferring rotation of the lock beam assembly to the hooked lock beam.

As a further solution of the present disclosure, the hooked lock beam is provided with a first lock beam, and a second lock beam. One end of the first lock beam is provided with a first hook claw, and the other end of the first lock beam is provided with a first gear. One end of the second lock beam is provided with a second hook claw, and the other end of the second lock beam is provided with a second gear. The first gear and the second gear are meshed with each other, thus making the first lock beam and the second lock beam synchronously inserted into the trigger guard to lock the pistol, or synchronously retract from the trigger guard to unlock the pistol.

As a further solution of the present disclosure, the lock catch structure is further provided with a latch bolt tab and a latch bolt spring. The latch bolt tab is movably connected to the lock catch bracket, one end of the latch bolt spring is abutted against the lock catch bracket, and the other end of the latch bolt spring is abutted against the latch bolt tab. An outer side of the annular lock beam is provided with a locking notch, and the latch bolt tab is wedged into the locking notch under the driving of the latch bolt tab, thus forming a locking state for the annular lock beam.

As a further solution of the present disclosure, the lock catch structure is further provided with a locking push rod, and a push rod spring. The locking push rod is movably connected to the body, one end of the push rod spring is abutted against the locking push rod, and the other end of the push rod spring is abutted against the body. One end of the locking push rod extends into the body and is abutted against the handle post, and the other end of the locking push rod extends out of the body and is provided with a hand-pressing bump. The lock beam assembly is further provided with a lock beam torsional spring, one end of the lock beam torsional spring is abutted against the lock catch bracket, and the other end of the lock beam torsional spring is abutted against the annular lock beam to keep the annular lock beam in an unlocked state. The handle post can be driven to move synchronously by pressing the hand-pressing bump, thus enabling the annular lock beam to rotate by a certain angle to lock the trigger guard.

As a further solution of the present disclosure, the unlocking mechanism is further provided with an electronic unlocking mechanism. The electronic unlocking mechanism is provided with a gear motor, an electric cam, a circuit board, a control chip, a power supply component, and a password input component. The circuit board and the power supply component are fixedly connected to the body, respectively. The gear motor, the control chip, the power supply component and the password input component are electrically connected through the circuit board. The gear motor is fixedly connected to the lock catch bracket, and the electric cam is fixedly connected to a rotating shaft of the gear motor. The gear motor is configured to drive the electric cam to rotate to push the bolt tab to move, thus forming an unlocked state.

As a further solution of the present disclosure, the electronic unlocking mechanism is further provided with a fingerprint recognition component, which is fixedly connected to the body, electrically connected to the control chip, and configured to set and recognize corresponding fingerprints.

As a further solution of the present disclosure, the unlocking mechanism is further provided with a control button, and a lock control switch. The control button is fixedly connected to the body, electrically connected to the control chip, and configured to control and manage the electronic unlocking mechanism. The lock control switch is fixedly connected to the lock catch bracket and electrically connected to the control chip. The lock beam assembly is abutted against the lock control switch while locking the trigger guard, thus enabling the lock control switch to send a lock control signal to the control chip. The control chip, after receiving the lock control signal, is configured to lock the control button, making the control button unable to control or manage the electronic unlocking mechanism.

Compared with the prior art, the present disclosure has beneficial effects as follows:

1. A lock beam assembly is arranged, particularly, one end of the lock beam assembly passes through a trigger guard of the pistol with a rotation radius thereof as a motion trajectory, thus locking the pistol rapidly. In addition, the lock beam assembly may also be arranged on the other side, opposite to a pistol grip, of the trigger guard, such that the user can pull out the pistol during unlocking rotation of the lock beam assembly, achieving the effect of pulling out the gun rapidly.
2. The first lock beam and the second lock beam are arranged to form a dual-hook embracing design. Internal gears are meshed with each other to achieve synchronous rotation on both left and right sides and simultaneous anchoring and locking. The locking speed can be improved, and the locking strength can be enhanced, thus further improving the locking security of the pistol. In addition, during unlocking, synchronous rotation of the two gears may also be used for synchronous unlocking, thus achieving the effect of rapid unlocking and quick drawing of the pistol.
3. By arranging the control button and the lock control switch, and pressing the lock control switch with the lock beam assembly, the control chip, after receiving the lock control signal, can be configured to lock the control button to disable corresponding functions of the control button. Therefore, when the pistol is locked in the storage device, the electronic unlocking mechanism cannot be set, making the security further improved.

Therefore, through above improvement, the present disclosure can provide a semi-open pistol storage device. Through the semi-open pistol storage device, the pistol can be conveniently stored, rapidly positioned and locked in the device, or rapidly drawn from the device. The user can put and take the pistol quickly during use, and the storage safety of the pistol can be improved.

Additional aspects and advantages of the present disclosure will be set forth in part in the following description, and in part will become apparent from the following description, or may be learned through the practice of the present disclosure.

BRIEF DESCRIPTION OF THE DRAWINGS

To describe the technical solutions of the present disclosure or in the prior art more clearly, the following briefly introduces the accompanying drawings required for describing the embodiments or the prior art. Apparently, the accompanying drawings in the following description show merely some embodiments of the present disclosure, and those of ordinary skill in the art may still derive other drawings from these accompanying drawings without creative efforts.

REFERENCE NUMERALS AND NAMES IN THE DRAWINGS ARE AS FOLLOWS

Figure 1:
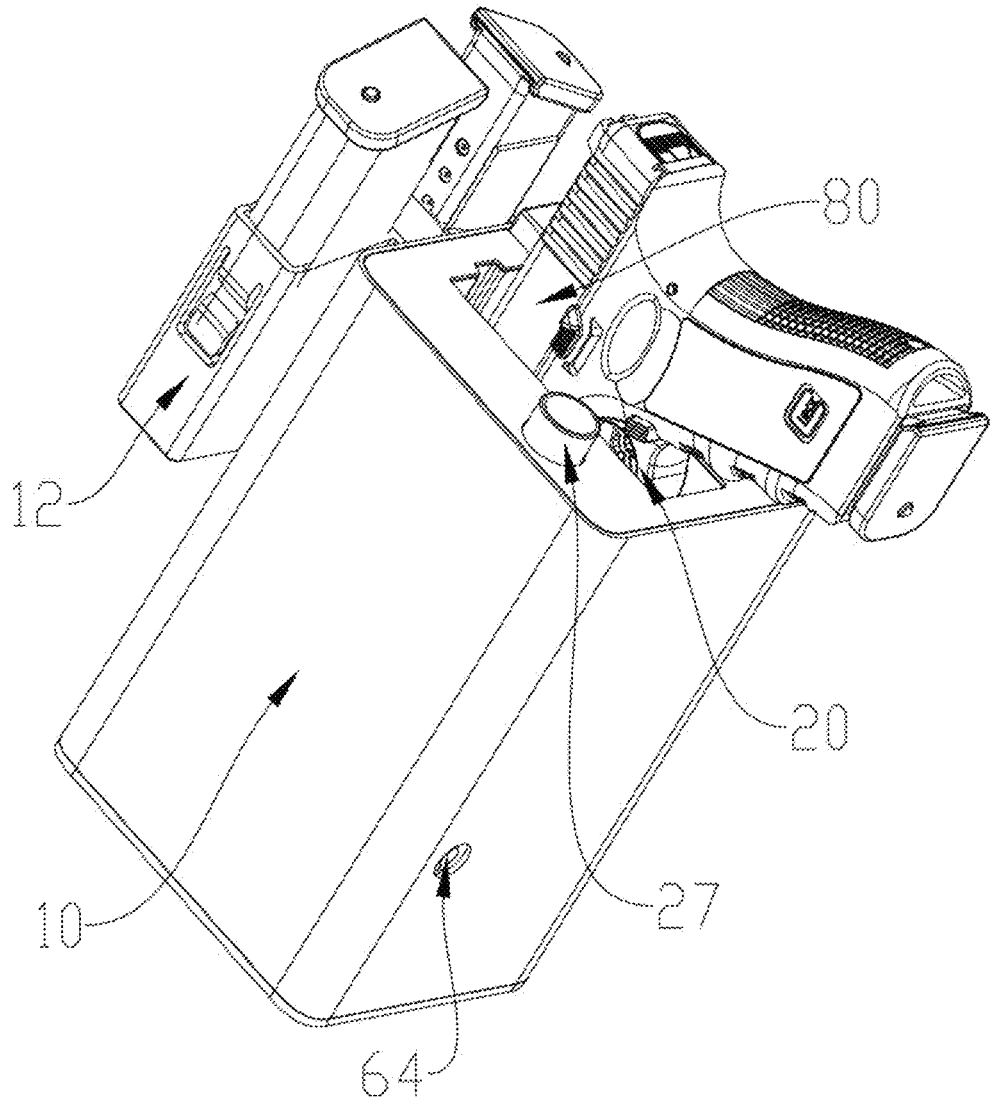
FIG. 1 is a structural diagram of a use state of a body according to the present disclosure.

10—body; 11—accommodating cavity; 12—magazine structure; 13—wall—hanging structure; 20—lock catch structure; 21—lock catch bracket; 22—first connecting post; 23—lock beam stop plate; 24—latch bolt tab; 25—latch bolt spring; 26—locking push rod; 27—hand-pressing bump; 30—lock beam assembly; 31—third gear; 32—fourth gear; 33—lock beam torsional spring; 40—annular lock beam; 41—internal gear teeth; 42—locking notch; 43—first connecting hole; 44—lock hook; 45—handle post; 50—hooked lock beam; 51—hook claw; 52—lock beam gear; 53—first lock beam; 54—first hook claw; 55—first gear; 56—second lock beam; 57—second hook claw; 58—second gear; 60—unlocking mechanism; 61—unlocking bump; 62—control button; 63—lock control switch; 64—mechanical lock; 65—mechanical cam; 70—electronic unlocking mechanism; 71—gear motor; 72—electric cam; 73—circuit board; 74—control chip; 75—power supply component; 76—password input component; 77—fingerprint recognition component; 78—charge interface; 80—pistol; 81—trigger guard.

DETAILED DESCRIPTION OF THE EMBODIMENTS

The following clearly and completely describes the technical solutions in the embodiments of the present disclosure.

Apparently, the described embodiments are merely a part rather than all of the embodiments of the present disclosure. All other embodiments obtained by those of ordinary skill in the art based on the embodiments of the present disclosure without creative efforts shall fall within the scope of protection of the present disclosure.

Please referring to FIG. 1 to FIG. 7, the present disclosure provides a semi-open pistol storage device, including a body 10 with an accommodating cavity 11. The accommodating cavity 11 is used for storing a pistol 80, the body 10 is provided with a lock catch structure 20, and an unlocking mechanism 60. The lock catch structure 20 is provided with a lock catch bracket 21, and a lock beam assembly 30. The lock catch bracket 21 is fixedly connected to the body 10, the lock beam assembly 30 is rotatably connected to the lock catch bracket 21, and one end of the lock beam assembly 30 passes through a trigger guard 81 of the pistol 80 with a rotation radius thereof as a motion trajectory to lock the pistol 80. The unlocking mechanism 60 is provided with an unlocking bump 61, which can unlock the lock catch structure 20 to make the lock beam assembly 30 retract from the trigger guard 81, thus releasing the trigger guard 81 and enabling the pistol 80 to be drawn from the storage device.

Specifically, a body 10 of the storage device needs to be provided to store the pistol 80 correspondingly. However, to reduce the size, the style of the storage box can be adopted to store a barrel and a trigger part of the pistol 80 correspondingly, and a grip of the pistol 80 can be exposed outside the box body, thus facilitating a user to rapidly hold the grip to pull out the pistol 80. To achieve the locking of the pistol, there is also a need to arrange a corresponding lock catch structure 20 in the body 10. A lock beam of the lock latch structure 20 is configured to lock the trigger guard 81, thus completing safe storage of the pistol 80.

Secondarily, the lock beam assembly 30 can be arranged in the body 10 at an initial position. When the pistol 80 needs to be locked, the lock beam assembly 30 can pass through the accommodating cavity 11 and can be inserted into the trigger guard 81 of the pistol 80 stored in the accommodating cavity 11, thus achieving the locking of the pistol 80. Preferably, the accommodating cavity 11 is arranged at a middle part in an axial direction of the body 10, thus accommodating the barrel part of the pistol 80 into the middle part of the body 10. Further, a magazine structure 12 and a wall-hanging structure 13 can be added on a side wall of the body 10. The magazine structure 12 can be configured to store extra magazine to expand ammunition quantity of the pistol 80. Moreover, the wall-hanging structure 13 can be configured to fix the storage device to an external desk, wall, carriage, and other places where the user can pull the pistol out relatively conveniently, thus facilitating the placement of the storage device and the rapid use of the pistol 80.

Figure 4:
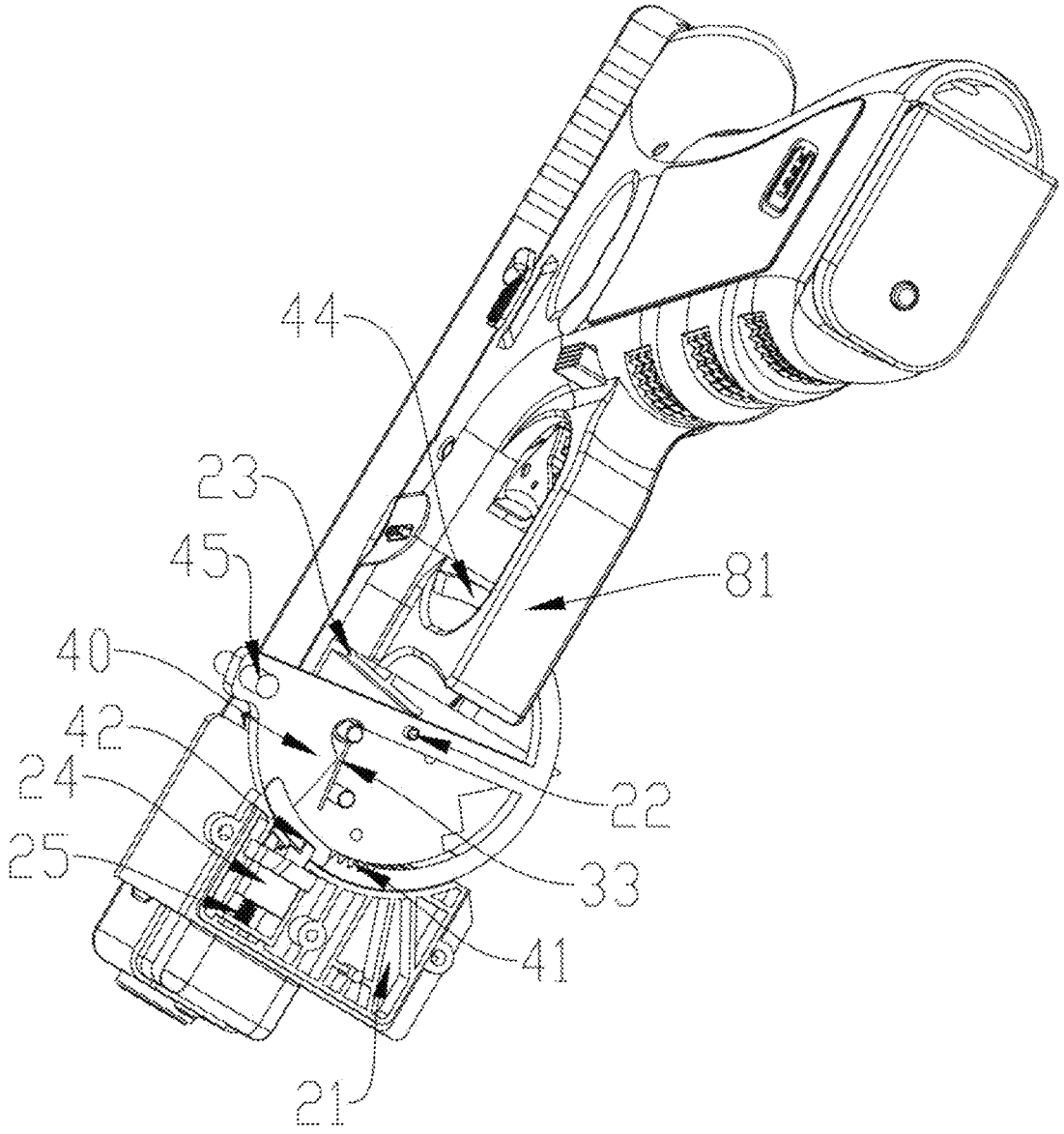
FIG. 4 is a structural diagram of a first embodiment according to the present disclosure.
Figure 5:
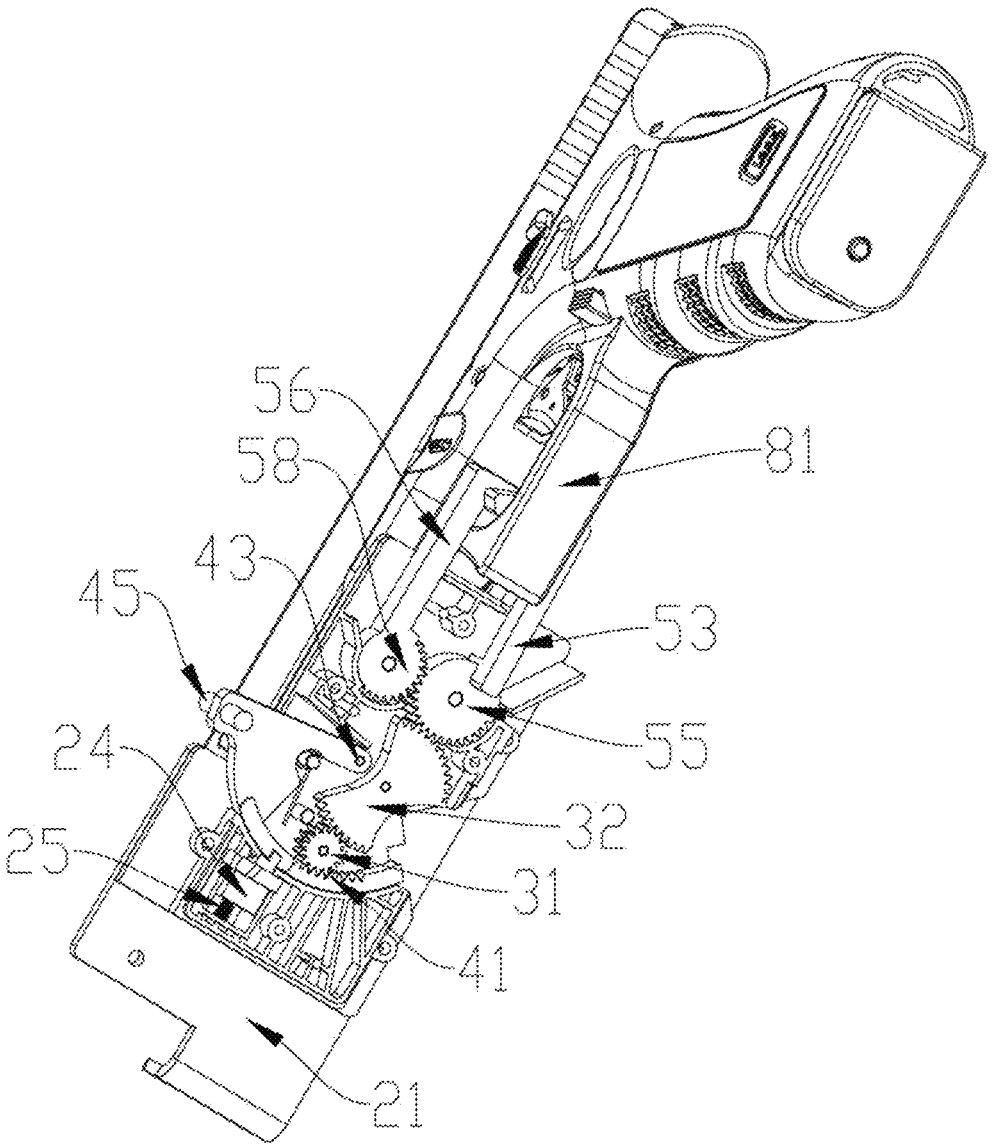
FIG. 5 is a structural diagram of a locked state of a hooked lock beam according to the present disclosure.
Figure 6:
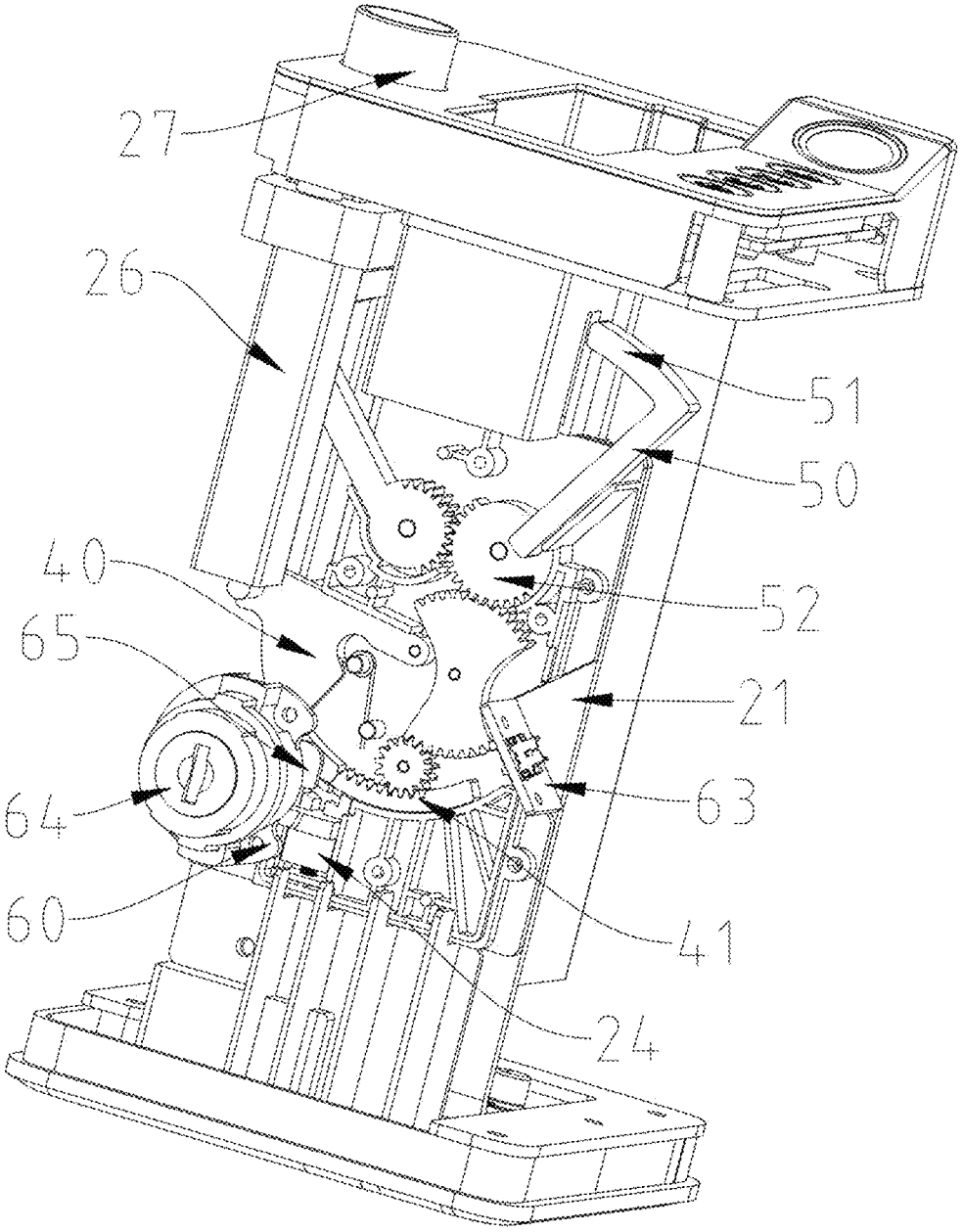
FIG. 6 is a structural diagram of an unlocked state of a hooked lock beam according to the present disclosure.

Thirdly, preferably, the lock beam assembly 30 and the grip of the pistol 80 are respectively located on both sides of the trigger guard 81 in an axial line of a drawing direction of the pistol 80. That is, the lock beam assembly 30 can also be arranged on the other side, opposite to the grip, of the trigger guard 81, enabling the user to draw the pistol 80 during unlocking rotation of the lock beam assembly 30, and further achieving the effect of fast gun drawing. In addition, preferably, a rotation plane of the lock beam assembly 30 is approximately perpendicular to a plane where the trigger guard 81 is located. Preferably, the rotation plane of the lock beam assembly 30 is approximately parallel to an axial line of the drawing direction of the pistol 80. That is, the rotation plane of the lock beam assembly 30 can be further optimized, thus achieving rapid placement of the pistol 80, or rapid drawing of the pistol 80. As shown in FIG. 4 to FIG. 6, when the lock beam assembly 30 is in a position shown in the diagram, and kept at a relative orientation with the pistol 80 in the drawing, it is most conducive to achieving rapid storage and quick drawing of the pistol 80.

In a first embodiment, as shown in FIG. 4, preferably, the lock beam assembly 30 is provided with an annular lock beam 40, the annular lock beam 40 is rotatably connected to the lock catch bracket 21 along a center shaft thereof, one end of the annular lock beam 40 is provided with a lock hook 44, and the other end of the annular lock beam 40 is provided with a handle post 45. By pushing the handle post 45, the annular lock beam 40 can be rotated by a certain angle, thus enabling the lock hook 44 to pass through the trigger guard 81 of the pistol 80 with a rotation radius as a motion trajectory to lock the pistol 80.

Specifically, in the first embodiment, to reduce the volume of the storage device as much as possible, a corresponding lock hook 44 can be directly arranged on the annular lock beam 40, the lock hook 44, when rotating synchronously with the annular lock beam 40, can pass through the trigger guard 81 for locking, thus achieving a locking function of the pistol 80. Moreover, to improve the rotation speed of the annular lock beam 40, it is preferably to rotatably connect the annular lock beam 40 to the lock catch bracket 21 with the center shaft thereof as the center of rotation. That is, a first connecting hole 43 may also be arranged at the axes of the annular lock beam 40, a part, corresponding to the first connecting hole 43, of the lock catch bracket 21 is provided with a first connecting post 22, and the annular lock beam 40 is rotatably connected to the corresponding first connecting post 22 through the first connecting hole 43. When the handle post 45 is pushed, the annular lock beam 40 can be enabled to rotate around the first connecting post 22 corresponding to the first connecting hole 43 by a certain angle. Moreover, the handle post 45 is preferably arranged on a radial direction of the annular lock beam 40, thus driving the annular block beam better.

In a second embodiment, preferably, the lock beam assembly 30 is provided with a hooked lock beam 50, one end of the hooked lock beam 50 is provided with a hook claw 51, and the other end of the hooked lock beam 50 is provided with a lock beam gear 52. A center shaft of the lock beam gear 52 is rotatably connected to the lock catch bracket 21, and an inner side of the lock beam assembly 40 is provided with internal gear teeth 41. The internal gear teeth 41 are meshed with gear teeth of the lock beam gear 52, enabling the lock beam assembly 30 to drive the hooked lock beam 50 to synchronously rotate by a certain angle, and further enabling the hook claw 51 to pass through the trigger guard 81 of the pistol 80 with a rotation radius thereof as a motion trajectory to lock the pistol 80.

Specifically, to increase a movement angle of the annular lock beam 40, the annular lock beam 40 moves with a smaller angle to achieve the locking of the trigger guard 81. Moreover, a corresponding hooked lock beam 50 can be arranged. A relatively long moment can be formed by a relatively long distance from the hook claw 51 of the hooked lock beam 50 to its rotating center shaft, and small rotation of the lock beam gear 52 can enable the hook claw 51 to travel longer path to pass through the trigger guard 81 to form a locked state. In addition, the shape of the hooked lock beam 50 may be arranged to be 7-shaped, the teeth of the lock beam gear 52 can also be designed as sector gear teeth, which allows the annular lock beam 40 to drive the lock beam gear 52 with its internal gear teeth 41. Moreover, it can be understood that the hook claw 51 can be arranged to be annular, which not only can form certain claw-shaped locking for the trigger guard 81, but also can rotate along its rotation radius during rotation to rapidly lock or unlock the trigger guard 81. In this embodiment, as the annular lock beam 40 is directly meshed with the hooked lock beam 50, a corresponding arrangement space is limited, and only one hooked lock beam 50 can be arranged.

In a third embodiment, as shown in FIG. 5 and FIG. 6, preferably, the lock beam assembly 30 is further provided with a third gear 31 and a fourth gear 32 rotatably connected to the lock catch bracket 21, respectively. The third gear 31 is meshed with the internal gear teeth 41 and the fourth gear 32, respectively. The fourth gear 32 is meshed with the third gear 31 and the lock beam gear 52, respectively, thus transferring rotation of the lock beam assembly 40 to the hooked lock beam 50. The hooked lock beam 50 is provided with a first lock beam 53, and a second lock beam 56. One end of the first lock beam 53 is provided with a first hook claw 54, and the other end of the first lock beam 53 is provided with a first gear 55. One end of the second lock beam 56 is provided with a second hook claw 57, and the other end of the second lock beam 56 is provided with a second gear 58. The first gear 55 and the second gear 58 are meshed with each other, thus making the first lock beam 53 and the second lock beam 56 synchronously inserted into the trigger guard 81 to lock the pistol 80, or synchronously retract from the trigger guard 81 to unlock the pistol 80.

Specifically, to further enhance the locking effect to the trigger guard 81, two hooked lock beams 50 can be arranged to form a dual-hook embracing design. Internal gears are meshed with each other to achieve synchronous rotation on both left and right sides and simultaneous anchoring and locking. The locking speed can be improved, and the locking strength can be enhanced, thus further improving the locking security of the pistol 80. In addition, during unlocking, synchronous rotation of the two gears may also be used for synchronous unlocking, thus achieving the effect of rapid unlocking and quick drawing of the pistol. To leave corresponding arrangement space for the two hooked lock beams 50, it is preferably to provide the fourth gear 32 and the third gear 31, after moving the annular lock beam 40 downwards to make more space available, the fourth gear 32 and the third gear are meshed with each other to transfer a driving force of the annular lock beam 40 to the first gear 55. Meanwhile, the first gear 55 and the second gear 58 can be arranged to be meshed with each other, thus rotating the first lock beam 53 and the second lock beam 56 synchronously to achieve the operation of synchronous locking or synchronous unlocking.

Secondly, the third gear 31, the fourth gear 32, the first gear 55, and the second gear 58 can also be provided as sector gear teeth as required. In addition, it can be understood that to prevent the first lock beam 53 and the second lock beam 56 from rotating excessively during rotation and impacting the main body 10, a lock beam stop plate 23 can be installed at a corresponding position of the lock catch bracket 21, thus limiting the hooked lock beam 50 and preventing the hooked lock beam 50 from rotating excessively.

As shown in FIG. 4 to FIG. 7, preferably, the lock catch structure 20 is further provided with a latch bolt tab 24 and a latch bolt spring 25. The latch bolt tab 24 is movably connected to the lock catch bracket 21, one end of the latch bolt spring 25 is abutted against the lock catch bracket 21, and the other end of the latch bolt spring 25 is abutted against the latch bolt tab 24. An outer side of the annular lock beam 40 is provided with a locking notch 42, and the latch bolt tab 24 is wedged into the locking notch 42 under the driving of the latch bolt spring 25, thus forming a locking state for the annular lock beam 40.

Specifically, to keep the lock beam assembly 30 at a corresponding locking position, preferably, the latch bolt tab 24 may also be provided, which is driven by the latch bolt spring 25 to correspondingly lock the lock beam assembly 30. To facilitate unlocking, an unlocking bump 61 may also be arranged on one side of the latch bolt tab 24, the unlocking bump 61 is fixedly connected to the latch bolt tab 24 and configured to drive the latch bolt tab 24 to move a certain distance to retract from the lock catch notch 42, thus achieving unlocking. Certainly, the unlocking bump 61 can be driven by a mechanical cam 65 of a mechanical lock 64, or driven by an electric cam 72 of the electronic unlocking mechanism 70.

Figure 2:
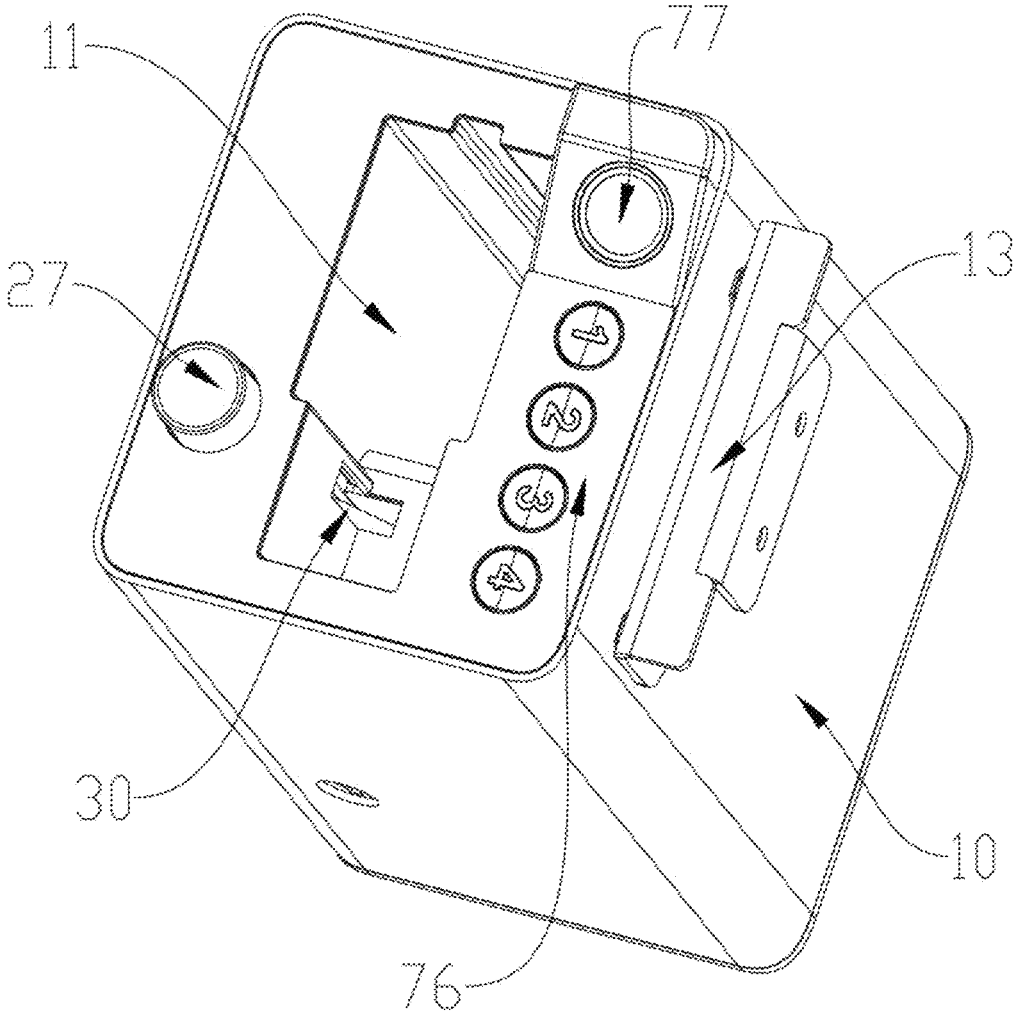
FIG. 2 is a structural diagram of an accommodating cavity according to the present disclosure.
Figure 3:
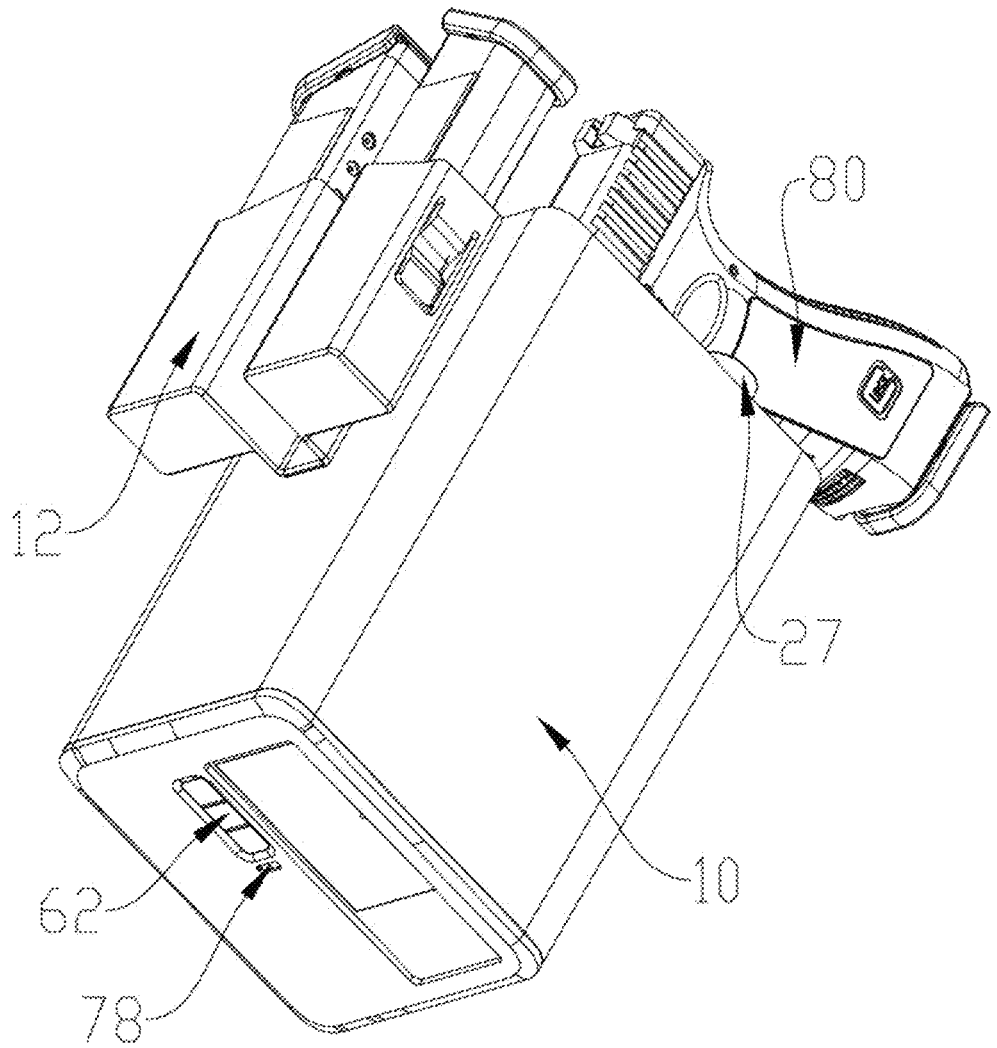
FIG. 3 is a structural diagram of a control button according to the present disclosure.

As shown in FIG. 1, FIG. 2 and FIG. 6, preferably, the lock catch structure 20 is further provided with a locking push rod 26, and a push rod spring (not shown in the figure). The locking push rod 26 is movably connected to the body 10, one end of the push rod spring is abutted against the locking push rod 26, and the other end of the push rod spring is abutted against the body 10. One end of the locking push rod 26 extends into the body 10 and is abutted against a handle post 45, and the other end of the locking push rod 26 extends out of the body 10 and is provided with a hand-pressing bump 27. The lock beam assembly 30 is further provided with a lock beam torsional spring 33, one end of the lock beam torsional spring 33 is abutted against the lock catch bracket 21, and the other end of the lock beam torsional spring 33 is abutted against the annular lock beam 40, and the spring force of the lock beam torsional spring 33 can keep the annular lock beam 40 in an unlocked state. The hand-pressing bump 27 is pressed to drive the handle post 45 to move synchronously, thus rotating the annular lock beam 40 by a certain angle to lock the trigger guard 81.

Specifically, to rapidly achieve the locking operation, preferably, the hand-pressing bump 27 is positioned on the side where the pistol 80 is stored into the storage device. Therefore, after the pistol 80 is placed in the accommodating cavity 11, the hand-pressing bump 27 can be quickly pressed with a finger to lock the pistol 80 into the storage device. In addition, during locking, the locking push rod 26 is required for manual locking. But during unlocking, instead of manual operation, the spring force of the lock beam torsional spring 33 is used for directly releasing the lock, thus accelerating the unlocking speed, allowing the user to quickly unlock and take the pistol 80 for corresponding operation when needed. Secondly, due to the spring force of the lock beam torsional spring 33, the lock beam assembly 30 can rotate continuously towards a rotation direction of unlocking, and thus the lock beam stop plate 23 can be arranged on the lock catch bracket 21, and the lock beam stop plate 23 is fixedly connected to the lock catch bracket 21, and has a limiting abutting effect on the annular lock beam 40.

As shown in FIG. 6, preferably, the unlocking mechanism 60 is provided with a mechanical lock 64, and a mechanical cam 65. The mechanical lock 64 is fixedly connected to the body 10, and the mechanical cam 65 is fixedly connected to a rotating shaft of the mechanical lock 64. When the mechanical lock 64 is unlocked by an external key, the key is rotated to make the rotating shaft rotate synchronously, the mechanical cam 65 is driven to rotate to push the latch bolt tab 24 to move a certain distance towards a direction of exiting from the locking notch 42, thus enabling the annular lock beam 40 to rotate by a certain angle under the spring force of the lock beam torsional spring 33 to form an unlocked state.

Specifically, to ensure that the storage device can still be unlocked to take out the pistol 80 in the event of a malfunction with the electronic unlocking mechanism 70, a corresponding mechanical lock 64 and a mechanical key can be installed. Certainly, it is also necessary to provide a corresponding unlocking hole (not shown in the figure) at a position, corresponding to the mechanical lock 64, at the outer part of the body 10.

Figure 7:
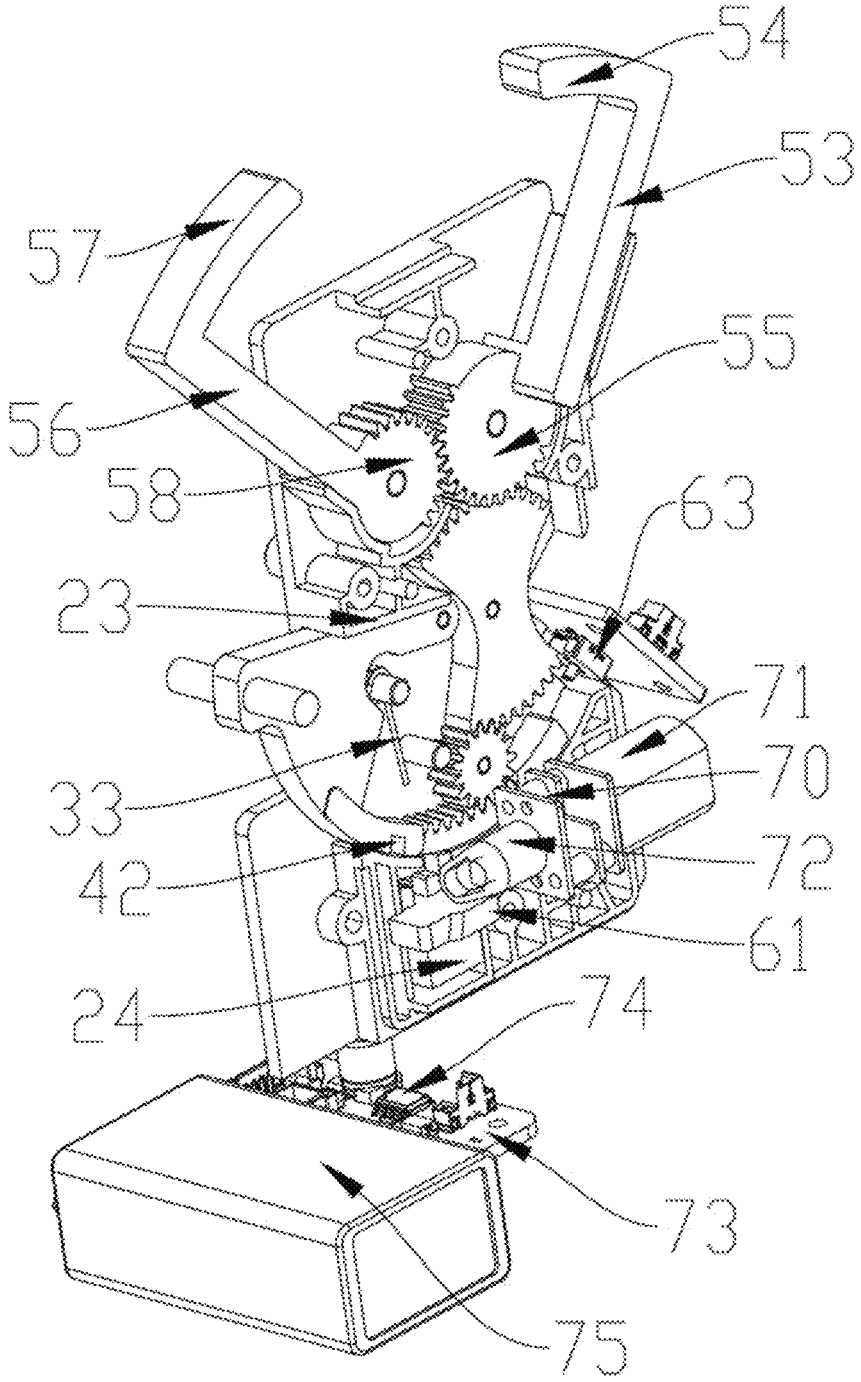
FIG. 7 is a structural diagram of an electronic unlocking mechanism according to the present disclosure.

As shown in FIG. 7, preferably, the unlocking mechanism 60 is further provided with an electronic unlocking mechanism 70, the electronic unlocking mechanism 70 is provided with a gear motor 71, an electric cam 72, a circuit board 73, a control chip 74, a power supply component 75, and a password input component 76. The circuit board 73 and the power supply component 75 are fixedly connected to the body 10, respectively. The gear motor 71, the control chip 74, the power supply component 75 and the password input component 76 are electrically connected through the circuit board 73. The gear motor 71 is fixedly connected to the lock catch bracket 21, and the electric cam 72 is fixedly connected to a rotating shaft of the gear motor 71. The gear motor 71 is configured to drive the electric cam 72 to rotate to push the bolt tab 24 to move, thus forming an unlocked state.

Specifically, the password input component 76, when receiving a correct preset password, is configured to send an unlocking signal to the control chip 74. The control chip 74, after receiving the unlocking signal, is configured to control the gear motor 71 to rotate to drive the electric cam 72 to rotate synchronously to push the latch bolt tab 24 to move a certain distance towards the direction of exiting the lock catch notch 42, thereby achieving an unlocked state. The gear motor 71 may be a stepper motor, or a regular motor provided with a reduction gear, which can provide a certain moment of rotation to push the latch bolt tab 24 to move away from the locking notch 42, thereby achieving the unlocking operation. The electric cam 72 can push the same unlocking bump 61 on the latch bolt tab 24 as the mechanical cam 65 does. Alternatively, two different unlocking bumps 61 may also be arranged on the latch bolt tab 24, such that the electric cam 72 and the mechanical cam 65 can respectively push different unlocking bumps 61, and both can push the latch bolt tab 24 to move. It may be understood that the control chip 74 is also internally provided with a corresponding driving module or driver program for the gear motor 71.

Secondly, the power supply component 75 may also be provided with a battery and a charge interface 78. The battery is preferably a chargeable battery, and the charge interface 78 is configured to charge the battery. The control chip 74 may also be internally provided with an existing program or module in the prior art to charge and discharge the battery. The battery is configured to supply power to an electronic element in the body 10. The password input component 76 may also be provided with multiple password input keys, thus setting and inputting the password. It may be understood that the control chip 74 may also be provided with a password preset program and a password comparison program, thus managing and comparing the password input by the user. When the input password is correct, the gear motor 71 can be driven to perform corresponding rotation unlocking.

As shown in FIG. 6 and FIG. 7, preferably, the unlocking mechanism 60 is further provided with a control button 62, and a lock control switch 63. The control button 62 is fixedly connected to the body 10, electrically connected to the control chip 74, and configured to control and manage the electronic unlocking mechanism 70. The lock control switch 63 is fixedly connected to the lock catch bracket 21 and electrically connected to the control chip 74. the lock beam assembly 30 is abutted against the lock control switch 63 while locking the trigger guard 81, thus enabling the lock control switch 63 to send a lock control signal to the control chip 74; and the control chip 74, after receiving the lock control signal, is configured to lock the control button 62, making the control button 62 unable to control or manage the electronic unlocking mechanism 70.

Specifically, the control button 62 is configured to add or delete password or fingerprint, or configured to perform other corresponding key control operations. When the pistol 80 is locked in the storage device, it is preferably set that the electronic unlocking mechanism 70 cannot be set, thus further improving the security. To eliminate the need for hiding the control button 62, the lock control switch 63 can be provided. After the lock control switch is configured to automatically detect that the annular lock beam 40 is locked, the control chip 74 can be enabled to deactivate the control button 62. After the pistol 80 is correspondingly unlocked and released, the control button 62 can enter an available standby state again. In addition, the lock control switch 63 may be set by a touch switch, a micro-switch, and other products in the existing products.

As shown in FIG. 2, preferably, the electronic unlocking mechanism 70 is further provided with a fingerprint recognition component 77, which is fixedly connected to the body 10, electrically connected to the control chip 74, and configured to set and recognize corresponding fingerprints.

Specifically, the fingerprint recognition component 77, after receiving a correct preset fingerprint, is configured to send an unlocking signal to the control chip 74. The control chip 74, after receiving the unlocking signal, is configured to control the gear motor 71 to rotate to drive the electric cam 72 to rotate synchronously, thus pushing the latch bolt tab 24 to move a certain distance towards the direction of exiting the lock catch notch 42 to achieve an unlocked state. The fingerprint recognition component 77 may employ existing products in the prior art, and a corresponding control program or control module is pre-recorded in the control chip 74 to drive the fingerprint recognition component 77 for fingerprint input and comparison. After the correct fingerprint is input, the control chip 74 can control the gear motor 71 to perform corresponding unlocking operation. In addition, preferably, the fingerprint recognition component 77 and the password input component 76 may also be arranged on an independent circuit board 73, and electrically connected to the control chip 74.

During use, when locking is needed, after the pistol 80 is placed in the storage device, the storage device can be operated with one hand (assuming that the user is a right-handed user), and the locking push rod 26 can be pressed with the thumb until the locking push rod 26 is approximately flush with an outer surface of the body 10. At this time, a lower part of the locking push rod 26 synchronously drives the handle post 45 to rotate the annular lock beam 40 for a certain angle, thus driving the hooked lock beam 50 to rotate synchronously. The hook claw 51 of the hook lock beam 50, after partially rotating, can pass through the trigger guard 81 to achieve the locking of the pistol 80. Meanwhile, the latch bolt tab 24 may also be wedged into the locking notch 42 of the annular lock beam 40 to keep the lock catch structure 20 in a locked state. In addition, the user may also be a left-handed user, and the action of pressing the locking push rod 26 may also be implemented, except that the pressed finger become the index finger of the left hand.

A specific internal structure of the body 10 is linked through a corresponding gear. When the locking push rod 26 triggers the annular lock beam 40, the center shaft of the annular lock beam 40 is rotatably connected to the lock catch bracket 21, thus driving the third gear 31 in the middle through a circular motion. The third gear 31 is configured to drive the fourth gear 32 to rotate synchronously through meshing, the teeth of the fourth gear 32 are meshed with the first gear 55 of the first lock beam 53, and then the force is transmitted to the second gear 58 of the second lock beam 56, making the first hook claw 54 and the second hook claw form two clamping actions to synchronously pass through the trigger guard 81 to lock the pistol and fix the pistol into the storage device.

When unlocking is required, the unlocking action can be carried out through three modes, two of which are electronic control, i.e., a fingerprint unlocking mode, and a digital password unlocking mode, and the other is a pure mechanical unlocking mode, i.e., a key unlocking mode.

1. Fingerprint unlocking mode: when the user takes the gun with a right hand, a fingerprint module of the fingerprint recognition component 77 is pressed with an index finger of the right hand. After the fingerprint module collects correct fingerprint induction, a corresponding electrical signal is generated to the control chip 74. The control chip, after correspondingly processing the electric signal, sends an unlocking instruction. The motor, after receiving the unlocking instruction, drives the cam to rotate to push an internal latch bolt tab 24, the latch bolt tab 24 is compressed through a sliding chute and a spring structure to exit the locking notch 42 of the annular lock beam 40. Afterwards, the annular lock beam 40 is reset under the pre-spring force of the lock beam torsional spring 33 to form an unlocking action. Meanwhile, the handle post 45 of the annular lock beam 40 may be linked to the locking push rod 26 to reset the locking push rod 26. When the annular lock beam 40 performs the reset operation, the corresponding third gear 31, fourth gear 32, first gear 55 and second gear 58 can be synchronously driven to rotate the hooked lock beam 50 synchronously, which enables the hook claw 51 of the hooked lock beam to move a certain distance towards a direction away from the trigger guard 81 to unlock the trigger guard 81, making the pistol 80 in an unlocked state. Therefore, the user can take the pistol 80 rapidly for subsequent operation.
2. Password unlocking mode: after the user inputs the correct password, that is, the electric cam 72 is rotated by the motor to push the internal latch bolt tab 24, the latch bolt tab 24 is compressed by the sliding chute and the spring structure to exit the locking notch 42 of the ring lock beam 40 to achieve unlocking. The subsequent corresponding action is similar to that of the fingerprint unlocking mode, and thus will not be described in detail.
3. Mechanical key unlocking mode: after the user inserts an appropriate mechanical key and twists a key blade, a lock cylinder rotates to drive the corresponding mechanical cam 65 to rotate synchronously, which makes the mechanical cam 65 form a certain pressure on the unlocking bump 61, and enables the latch bolt tab 24 to form a compression action on the latch bolt spring 25, thus enabling the latch bolt tab 24 to exit the locking notch 42 of the annular lock beam 40 to achieve unlocking. The subsequent corresponding action is similar to that of the fingerprint unlocking mode, and thus will not be described in detail.

It should be noted that it is apparent to those skilled in the art that the present disclosure is not limited to the details of the above exemplary embodiments and can be implemented in other specific forms without departing from the spirit or basic characteristics of the present disclosure. Therefore, the embodiments should be considered as exemplary and non-limiting in all aspects, and the scope of the present disclosure is defined by the appended claims rather than the above description, so it is intended to encompass all changes that fall within the meaning and scope of the equivalent elements of the claims in the present disclosure.

What is claimed is:

1. A semi-open pistol storage device, comprising a body (10) with an accommodating cavity (11), wherein the accommodating cavity (11) is used for storing a pistol (80), the body (10) is provided with a lock catch structure (20), and an unlocking mechanism (60); the lock catch structure (20) is provided with a lock catch bracket (21), and a lock beam assembly (30); the lock catch bracket (21) is fixedly connected to the body (10), the lock beam assembly (30) is rotatably connected to the lock catch bracket (21), and one end of the lock beam assembly (30), with a rotation radius thereof as a motion trajectory, pass through a trigger guard (81) of the pistol (80) to lock the pistol (80); the unlocking mechanism (60) is provided with an unlocking bump (61), which is able to unlock the lock catch structure (20) to make the lock beam assembly (30) retract from the trigger guard (81), thus releasing the trigger guard (81) and enabling the pistol (80) to be drawn from the storage device;

wherein the lock beam assembly (30) is provided with an annular lock beam (40), the annular lock beam (40) is rotatably connected to the lock catch bracket (21) along a center shaft thereof, one end of the annular lock beam is provided with a lock hook (44), and the other end of the annular lock beam (40) is provided with a handle post (45); and by pushing the handle post (45), the annular lock beam (40) is able to be rotated by a certain angle, thus enabling the lock hook (44) to pass through the trigger guard (81) of the pistol (80) with a rotation radius as a motion trajectory to lock the pistol (80).

2. The semi-open pistol storage device according to claim 1, wherein the lock beam assembly (30) is provided with a hooked lock beam (50), one end of the hooked lock beam (50) is provided with a hook claw (51), and the other end of the hooked lock beam is provided with a lock beam gear (52); a center shaft of the lock beam gear (52) is rotatably connected to the lock catch bracket (21); an inner side of the lock beam assembly (30) is provided with internal gear teeth (41); and the internal gear teeth (41) are meshed with gear teeth of the lock beam gear (52), enabling the lock beam assembly (30) to drive the hooked lock beam (50) to synchronously rotate by a certain angle, and further enabling the hook claw (51) to pass through the trigger guard (81) of the pistol (80) with a rotation radius thereof as a motion trajectory to lock the pistol (80).

3. The semi-open pistol storage device according to claim 2, wherein the lock beam assembly (30) is further provided with a third gear (31) and a fourth gear (32) rotatably connected to the lock catch bracket (21), respectively; the third gear (31) is meshed with the internal gear teeth (41) and the fourth gear (32), respectively; the fourth gear (32) is meshed with the third gear (31) and the lock beam gear (52), respectively, thus transferring rotation of the lock beam assembly (30) to the hooked lock beam (50).

4. The semi-open pistol storage device according to claim 2, wherein the hooked lock beam (50) is provided with a first lock beam (53), and a second lock beam (56); one end of the first lock beam (53) is provided with a first hook claw (54), and the other end of the first lock beam (53) is provided with a first gear (55); one end of the second lock beam (56) is provided with a second hook claw (57), and the other end of the second lock beam (56) is provided with a second gear (58); the first gear (55) and the second gear (58) are meshed with each other, thus making the first lock beam (53) and the second lock beam (56) synchronously inserted into the trigger guard (81) to lock the pistol (80), or synchronously retract from the trigger guard (81) to unlock the pistol (80).

5. The semi-open pistol storage device according to claim 1, wherein the lock catch structure (20) is further provided with a latch bolt tab (24) and a latch bolt spring (25), wherein the latch bolt tab (24) is movably connected to the lock catch bracket (21), one end of the latch bolt spring (25) is abutted against the lock catch bracket (21), and the other end of the latch bolt spring (25) is abutted against the latch bolt tab (24); an outer side of the annular lock beam (40) is provided with a locking notch (42), and the latch bolt tab (24) is wedged into the locking notch (42) under the driving of the latch bolt tab (25), thus forming a locking state for the annular lock beam (40).

6. The semi-open pistol storage device according to claim 1, wherein the lock catch structure (20) is further provided with a locking push rod (26), and a push rod spring; the locking push rod (26) is movably connected to the body (10), one end of the push rod spring is abutted against the locking push rod (26), and the other end of the push rod spring is abutted against the body (10); one end of the locking push rod (26) extends into the body (10) and is abutted against the handle post (45), and the other end of the locking push rod (26) extends out of the body (10) and is provided with a hand-pressing bump (27); the lock beam assembly (30) is further provided with a lock beam torsional spring (33), one end of the lock beam torsional spring (33) is abutted against the lock catch bracket (21), and the other end of the lock beam torsional spring (33) is abutted against the annular lock beam (40) to keep the annular lock beam (40) in an unlocked state; and the handle post (45) is able to be driven to move synchronously by pressing the hand-pressing bump (27), thus enabling the annular lock beam (40) to rotate by a certain angle to lock the trigger guard (81).

7. The semi-open pistol storage device according to claim 5, wherein the unlocking mechanism (60) is further provided with an electronic unlocking mechanism (70), the electronic unlocking mechanism (70) is provided with a gear motor (71), an electric cam (72), a circuit board (73), a control chip (74), a power supply component (75), and a password input component (76); the circuit board (73) and the power supply component (75) are fixedly connected to the body (10), respectively; the gear motor (71), the control chip (74), the power supply component (75) and the password input component (76) are electrically connected through the circuit board (73); the gear motor (71) is fixedly connected to the lock catch bracket (21), and the electric cam (72) is fixedly connected to a rotating shaft of the gear motor (71); and the gear motor (71) is configured to drive the electric cam (72) to rotate to push the latch bolt tab (24) to move, thus forming an unlocked state.

8. The semi-open pistol storage device according to claim 7, wherein the electronic unlocking mechanism (70) is further provided with a fingerprint recognition component (77), which is fixedly connected to the body (10), electrically connected to the control chip (74), and configured to set and recognize corresponding fingerprints.

9. The semi-open pistol storage device according to claim 7, wherein the unlocking mechanism (60) is further provided with a control button (62), and a lock control switch (63); the control button (62) is fixedly connected to the body (10), electrically connected to the control chip (74) and configured to control and manage the electronic unlocking mechanism (70); the lock control switch (63) is fixedly connected to the lock catch bracket (21) and electrically connected to the control chip (74); the lock beam assembly (30) is abutted against the lock control switch (63) while locking the trigger guard (81), thus enabling the lock control switch (63) to send a lock control signal to the control chip (74); and the control chip (74), after receiving the lock control signal, is configured to lock the control button (62), making the control button (62) unable to control or manage the electronic unlocking mechanism (70).

* * * * *